US011322862B2

(12) United States Patent
Ober-Woerder

(10) Patent No.: US 11,322,862 B2
(45) Date of Patent: May 3, 2022

(54) CONDUCTOR CONNECTION TERMINAL

(71) Applicant: WAGO Verwaltungsgesellschaft mbH, Minden (DE)

(72) Inventor: Philipp Ober-Woerder, Kirchlengern (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 7 days.

(21) Appl. No.: 17/144,854

(22) Filed: Jan. 8, 2021

(65) Prior Publication Data

US 2021/0210874 A1 Jul. 8, 2021

(30) Foreign Application Priority Data

Jan. 8, 2020 (DE) ..... 10 2020 100 218.1

(51) Int. Cl.
*H01R 4/48* (2006.01)
*H01R 25/14* (2006.01)
*H01R 9/24* (2006.01)

(52) U.S. Cl.
CPC ..... *H01R 4/4836* (2013.01); *H01R 9/2416* (2013.01); *H01R 25/14* (2013.01)

(58) Field of Classification Search
None
See application file for complete search history.

(56) References Cited

U.S. PATENT DOCUMENTS

| | | | | |
|---|---|---|---|---|
| 6,689,955 | B2 * | 2/2004 | Doutaz | H01R 4/4836 174/135 |
| 8,129,641 | B2 | 3/2012 | Majewski et al. | |
| 8,328,586 | B2 * | 12/2012 | Bies | H01R 4/4845 439/725 |
| 9,437,940 | B1 * | 9/2016 | Rao | H01R 9/24 |
| 9,466,895 | B2 * | 10/2016 | Kollmann | H01R 4/4836 |
| 9,525,216 | B2 * | 12/2016 | Wu | H01R 4/4809 |
| 9,543,700 | B2 * | 1/2017 | Kollmann | H01R 4/4836 |
| 10,164,349 | B2 | 12/2018 | Koellman | |
| 10,498,050 | B1 * | 12/2019 | Liang | H01R 4/4836 |
| 10,673,153 | B1 * | 6/2020 | Pan | H01R 13/506 |
| 10,847,920 | B2 * | 11/2020 | Pan | H01R 13/502 |

(Continued)

FOREIGN PATENT DOCUMENTS

| | | | |
|---|---|---|---|
| DE | 102007050936 | B4 | 7/2009 |
| DE | 102015119247 | A1 | 5/2017 |
| JP | 2014158905 | A | 9/2014 |

*Primary Examiner* — Ross N Gushi
(74) *Attorney, Agent, or Firm* — Muncy, Geissler, Olds & Lowe, P.C.

(57) ABSTRACT

A conductor connection terminal having at least one first spring-loaded clamping connection with a first operating lever for opening and closing a first clamping point formed between a first clamping leg and a first busbar section and at least one second spring-loaded clamping connection with a second operating lever for opening and closing a second first clamping point formed between a second clamping leg and a second busbar section and wherein the at least first spring-loaded clamping connection and the at least second spring-loaded clamping connection are arranged directly side by side in a direction of arrangement in a housing in the direction transverse to a conductor insertion direction. At least two operating levers arranged directly side by side in the direction of arrangement are designed differently.

15 Claims, 4 Drawing Sheets

(56) References Cited

U.S. PATENT DOCUMENTS

| | | | | |
|---|---|---|---|---|
| 2012/0178312 | A1 | 7/2012 | Hayashi et al. | |
| 2012/0238156 | A1* | 9/2012 | Hayashi | H01R 4/4872<br>439/820 |
| 2020/0343667 | A1* | 10/2020 | Geske | H01R 4/4836 |
| 2020/0395691 | A1* | 12/2020 | Stolze | H01R 9/26 |
| 2021/0013637 | A1* | 1/2021 | Spey | H01R 4/4836 |

* cited by examiner

CONDUCTOR CONNECTION TERMINAL

This nonprovisional application claims priority under 35 U.S.C. § 119(a) to German Patent Application No. DE 10 2020 100 218.1, which was filed in Germany on Jan. 8, 2020, and which is herein incorporated by reference.

BACKGROUND OF THE INVENTION

Field of the Invention

The present invention relates to a conductor connection terminal with a plurality of spring-loaded clamping connections arranged side by side in the direction of arrangement. In each case the conductor connection terminal has for each spring-loaded clamping connection, or at least for several spring-loaded clamping connections arranged directly side by side, an operating lever for opening and closing a clamping point of the spring-loaded clamping connection. The invention thus relates to the field of lever-operated conductor connection terminals.

Description of the Background Art

A conductor connection terminal is known from DE 10 2007 050 936 B4, which is incorporated herein by reference.

SUMMARY OF THE INVENTION

It is therefore an object of the present invention to make such a conductor connection terminal even more user-friendly.

This object is achieved in a conductor connection terminal of the aforementioned type in that at least two operating levers arranged directly next to each other in the direction of arrangement are formed differently, for example, have different shapes, and/or in that at least one operating lever has a gripping surface which is wider than the width of that housing section of the housing of the conductor connection terminal that is assigned to the spring-loaded clamping connection having the operating lever. In this case, each spring-loaded clamping connection can be arranged in a housing section of the conductor connection terminal that is respectively assigned to this spring-loaded clamping connection.

For example, the conductor connection terminal can be designed with the following features: at least one first spring-loaded clamping connection with a first operating lever for opening and closing a first clamping point formed between a first clamping leg and a first busbar section; and at least one second spring-loaded clamping connection with a second operating lever for opening and closing a second first clamping point formed between a second clamping leg and a second busbar section and wherein the at least first spring-loaded clamping connection and the at least second spring-loaded clamping connection are arranged directly side by side in the direction of arrangement in a housing transversely towards a conductor insertion direction, wherein the at least first operating lever and the at least second operating lever have different shapes and/or the at least first spring-loaded clamping connection is arranged in a first housing section of the conductor connection terminal assigned to the first spring-loaded clamping connection, wherein the at least first operating lever has a first gripping surface with a first width that is wider than the width of the first housing section in the direction of arrangement, and/or the at least second spring-loaded clamping connection is arranged in a second housing section of the conductor connection terminal assigned to the second spring-loaded clamping connection, wherein the at least second operating lever has a second gripping surface with a second width that is wider than the width of the second housing section in the direction of arrangement.

The invention has the advantage that diverse embodiment possibilities of the conductor connection terminal can be created with respect to the operating lever, since this operating lever must no longer be identically formed at a conductor connection terminal, as in the prior art, but it may be designed differently, that is, for example, have different shapes. In this way, both the accommodation of the operating lever in the housing of the conductor connection terminal and the possibilities for manual operation can be optimized.

In particular, the operating levers can be designed differently with regard to their gripping surfaces or other features that will be explained below. Manual handling for the user can be improved by optimizing the shape and the width of the gripping surface. In particular, a widening of the gripping surface is possible with a constant grid dimension of the conductor connection terminal. In particular with relatively small-sized conductor connection terminals, the gripping surfaces in the known embodiments can be relatively small. In the inventive conductor connection terminal, in particular the width of the gripping surface can be increased, which is made possible by the gripping surfaces of one, several or all operating levers have a width that is greater than the width of the housing section of the housing of the conductor connection terminal associated with the respective spring-loaded clamping connection in the direction of arrangement (A). The gripping surface can thus protrude laterally beyond the assigned housing section.

As mentioned, the width information relates to the direction of arrangement (A). In an advantageous embodiment, the direction of arrangement can extend perpendicular to the conductor insertion direction of the individual spring-loaded clamping connections of the conductor connection terminal. The conductor insertion direction is a direction defined by a conductor insertion opening and/or a conductor insertion channel, with which an electrical conductor to be connected to the spring-loaded clamping connection must be inserted into the conductor connection terminal.

The width of a housing section assigned to the respective spring-loaded clamping connection can correspond, for example, to the pitch or grid dimension of the conductor connection terminal. The pitch is understood to be the distance of the individual spring-loaded clamping connections transverse to the conductor insertion direction or the distance of the center lines of the conductor insertion directions from each other. As a result, the housing may also be structured in housing sections in that each spring-loaded clamping connection is assigned a housing interior region in the housing and the individual housing interior regions are separated from each other in each case via a partition wall inside the housing. The partition wall does not have to be a continuous wall, it can also have one or more openings. The housing may also be designed such that it is assembled from several individual housing modules, with the housing modules being consecutively aligned. For example, if exactly one spring-loaded clamping connection is arranged in a respective housing module, then this housing module forms the housing section associated with the spring-loaded clamping connection.

The sum of the first width (B1) and the second width (B2) can be greater than the sum of the width (BK) of the first housing section and the width (BK) of the second housing portion in the direction of arrangement (A). The first gripping surface and/or the second gripping surface can protrude beyond the area of the housing formed by the first housing section and the second housing section in the direction of arrangement, but this is not mandatory. Even without such a projection or with only partial projection, the sum of the widths mentioned can be greater than the width of the first and second housing sections combined. This is possible, for example, when the first and second gripping surfaces are arranged offset from one another.

The sum of the widths (B1, B2) of the gripping surfaces of all operating levers of the conductor connection terminal can be greater than the width of the entire housing in the direction of arrangement (A). The relation explained above for a partial area of the housing, namely the first and the second housing sections, of the sums mentioned can thus also apply to the entire housing. The outer gripping surfaces in the direction of arrangement can protrude beyond the housing in the direction of arrangement, but this is also not mandatory. The outer gripping surfaces in each case can also end flush with the housing or end set back in relation to the edge of the housing in the direction of arrangement.

The conductor connection terminal can have at least two different embodiments of operating levers, wherein the at least two different embodiments of the operating levers are at least in part arranged alternately side by side in the direction of arrangement (A). The alternating arrangement of the different operating levers can thus extend over all spring-loaded clamping connections of the conductor connection terminal or only over one or more sections of spring-loaded clamping connections arranged side by side. This has the advantage that only a small number of different embodiments of operating levers, for example only two different embodiments, have to be provided. This simplifies production and storage of the corresponding components. In addition, the conductor connection terminal offers an aesthetic appearance.

One, several or all of the operating levers can have an operating arm protruding from the housing, which merges at the free end into a gripping surface for manual operation of the operating lever. In particular, the at least first operating lever can have a first operating arm which merges into the first gripping surface at the free end. The at least second operating lever can have a second operating arm, which merges into the second gripping surface at the free end.

Differently designed operating levers can differ with regard to the length of an operating arm of the operating lever that protrudes from the housing. By means of such operating arms, which are of different lengths, an offset between adjacent gripping surfaces of the operating levers can be created in the longitudinal direction of the operating arms.

Differently designed operating levers can differ by different widths (B1, B2) of the gripping surfaces of the operating levers. For example, the widths of the gripping surfaces can have two different values that are arranged alternatingly side by side.

Differently designed operating levers can differ by means of different angled portions of the operating arm. In this way, the operation of the individual gripping surfaces can be made easier and more pleasant, in particular if they are arranged in an overlapping manner.

The first width (B1) of the first gripping surface in the direction of arrangement (A) can be greater than the width (B3) of the first operating arm of the first operating lever and/or the second width (B2) of the second gripping surface in the direction of arrangement (A) is greater than the width (B3) of the second operating arm of the second operating lever. In this way, a relatively large, ergonomically favorable gripping surface can be provided even with a comparatively small grid dimension of the conductor connection terminal. The gripping surface can thereby protrude beyond the respective operating arm in the direction of arrangement (A) either on only one side or on both sides.

The at least first operating lever and/or the second operating lever can have a T-shaped arrangement of operating arm and gripping surface. Accordingly, the gripping surface protrudes beyond the respective operating lever in the direction of arrangement on both sides. In particular, the T-shaped arrangement can be arranged symmetrically, that is to say that the extent to which the gripping surface protrudes beyond the operating arm in the direction of arrangement is the same on both sides of the operating arm.

The first gripping surface of the least first operating lever in the direction of arrangement (A) can extend up to the second operating arm of the adjacent second operating lever. In this way, the maximum amount of space is utilized for the first gripping surface, so that the first gripping surface can be maximized with regard to the surface area. The first gripping surface does not need to extend all the way to the second operating arm, so that it rests against it, but instead can end shortly before it, allowing for at least minimal play. In this way, the first gripping surface and the second operating arm can be moved past one another without colliding. The second gripping surface of the second operating arm can extend in the direction of arrangement (A) up to the gripping surface of the second following operating lever in the direction of arrangement (A), i.e. the operating lever following on the adjacent operating lever. The second gripping surface does not have to extend directly up to the gripping surface of the second following operating lever, but can end shortly before it, so that there is at least minimal play and the gripping surfaces can be moved past each other without collision.

It is advantageous, in this example, if the first operating arm is designed shorter than the second operating arm.

The first operating arm and/or the second operating arm can be oriented essentially perpendicular to the direction of arrangement (A) and/or a pivoting plane in which the first and/or the second operating lever can be pivoted is aligned essentially perpendicular to the direction of arrangement (A). In an advantageous embodiment of the invention, the pivoting planes of all the operating levers can be arranged parallel to one another.

The first and the second gripping surfaces can overlap perpendicular to the direction of arrangement (A). In particular, the first and second gripping surfaces can overlap in the direction of orientation of the operating arms in a plan view. An overlap in the vertical direction of the conductor connection terminal is also possible, wherein the vertical direction is that direction which extends perpendicular to the direction of arrangement and perpendicular to the conductor insertion direction. This allows for adjacent gripping surfaces with a relatively large surface area to be accommodated side by side.

The housing can have a housing module receiving one, two or more spring-loaded clamping connections. Such housing modules can be coupled to one another, for example via locking elements. In this way, the housing can be constructed in a modular manner from several housing modules. Two or more of the housing modules can be designed so that they can be lined up side by side. In particular, the housing modules can be designed so that they can be lined up side by side in the direction of arrangement (A).

In the context of the present invention, the undefined term "a" is not to be understood as a numerical word. If, for example, a component is mentioned, this is to be interpreted in the sense of "at least one component". As far as angles are given in degrees, these refer to a circle of 360 degrees (360°).

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
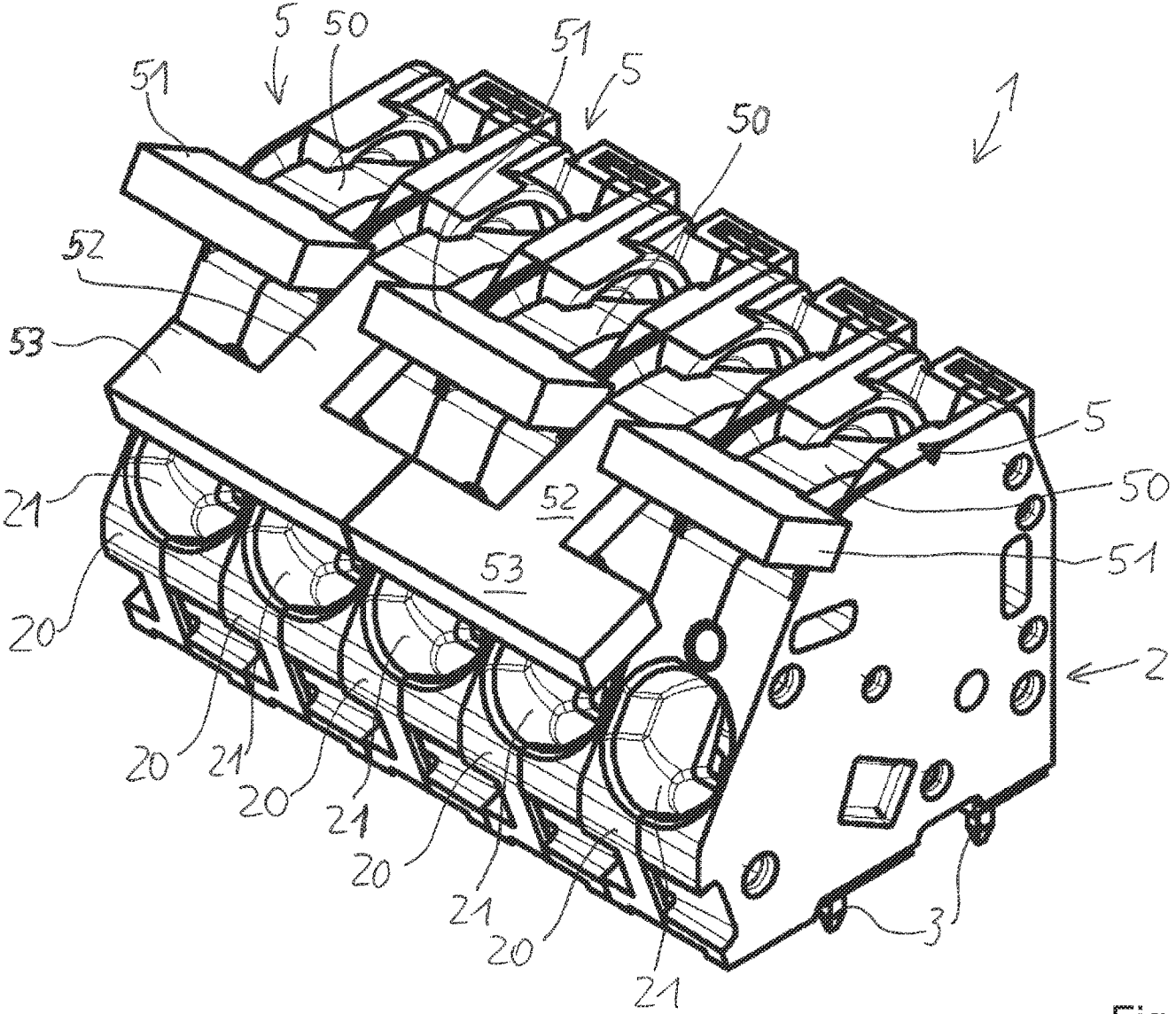
FIG. 1 shows a conductor connection terminal in a perspective view.

The conductor connection terminal 1 shown in FIG. 1 has a housing 2 which comprises several housing sections 20 arranged side by side. A spring-loaded clamping connection is arranged in each housing section 20. The respective spring-loaded clamping connection can have a clamping spring and a busbar section assigned to the clamping spring. The clamping spring has a clamping leg. The clamping leg forms a clamping point with the associated busbar section. The clamping spring can have further sections, such as, for example, a spring bow and a contact leg. Each housing section 20 can be formed from two housing halves and has a conductor insertion opening 21. An electrical conductor, which is to be clamped to the spring-loaded clamping connection, can be guided to the clamping point through the conductor insertion opening 21 and there can be clamped to the busbar section by means of the clamping leg.

The conductor connection terminal 1 has an operating lever 5 for each spring-loaded clamping connection, with which the clamping point of the spring-loaded clamping connection can be optionally opened or closed. The operating lever can, for example, actuate the clamping legs in such a way that, depending on the pivoting position of the operating lever, the clamping leg is moved away from the associated busbar section in such a way that the clamping point is open or is returned to the busbar section, if appropriate, by clamping the connected conductor. This corresponds to a closed clamping point.

Since the spring-loaded clamping connections are accommodated within the housing 2, they cannot be seen from the outside in the drawings. Only connection contacts 3, which protrude from the housing 2 on at least one side of the housing and are associated with the respective spring-loaded clamping connection are visible. The conductor connection terminal 1 can be set up, for example, for attachment to a circuit board. The connection contacts 3 can then be designed as solder contacts.

Each operating lever 5 has an operating arm 50, 52 protruding from the housing 2, which merges into a gripping surface 51, 53 at the free end. The gripping surface 51, 53 is used for manual operation of the operating lever 5.

It can be seen that the operating levers 5 are alternately designed differently. A first operation lever 5 has a first operating arm 50 and a first gripping surface 51. A second operating lever 5 arranged immediately adjacent thereto has a second operating arm 52 and a second gripping surface 53. The second operating arm 52 is longer than the first operating arm 50. Accordingly, the second gripping surface 53 protrudes further out of the housing 2 than the first gripping surface 51. The operating arms 50, 52 of the operating levers 5 also have different angled characteristics. Due to the different angled characteristics, the first gripping surfaces 51 are oriented more upwardly than the second gripping surfaces 53. All operating levers 5 are shown in the closed position in which the associated clamping point is also closed.

The proportions of the gripping surfaces 51, 53 in relation to the housing sections 20 of the conductor connection terminal 1 are to be explained with reference to FIG. 2. It can be seen that the first gripping surfaces 51 have a first width B1 in the direction of arrangement A. The second gripping surfaces 52 have a second width B2 in the direction of arrangement A. Both the first width B1 and the second width B2 are greater than the width BK of a housing section 20 in the direction of arrangement A. The second width B2 is greater than the first width B1. For example, these proportions for the gripping surfaces 51, 53 can increase the surface area of the first gripping surface 51 by approx. 50 percent as compared to embodiments in the prior art, and the surface area of the second gripping surface 53 even by approx. 100 percent. In this case, no change needs to be made to the grid dimension of the conductor connection terminal 1, that is, the predetermined, possibly relatively small grid dimension can still be maintained.

Figure 2:
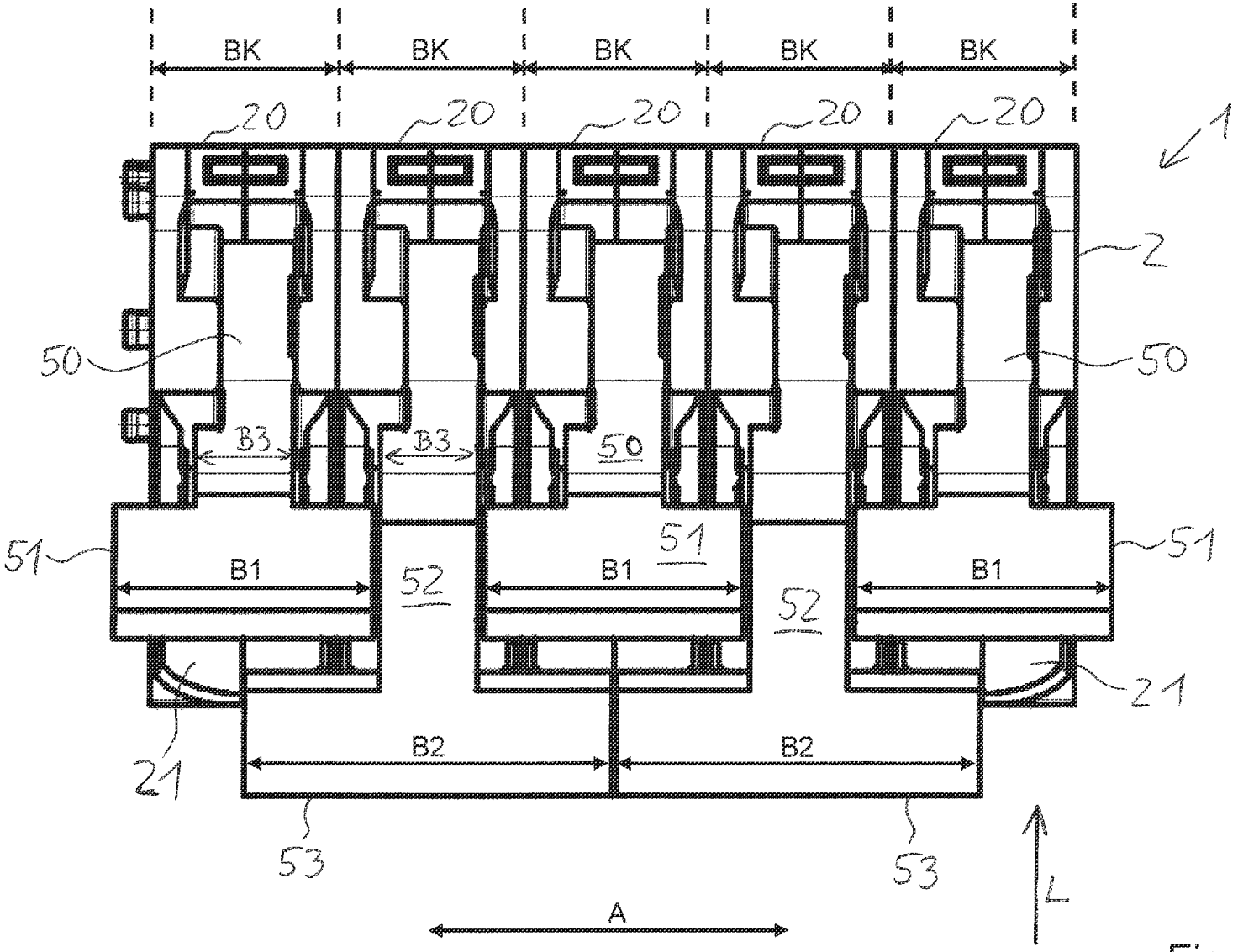
FIG. 2 shows the conductor connection terminal according to FIG. 1 in a plan view.

It can also be seen in FIG. 2 that the first gripping surface 51 extends in the direction of arrangement A at least approximately up to the second operating arm 52. The mutually adjacent second gripping surfaces 53 extend at least approximately up to one another, wherein between the mutually adjacent second operating arms 52 in each case a first operating arm 50 with a first gripping surface 51 is arranged. The essentially T-shaped arrangement of a respective operating arm 50, 52 and the gripping surface 51, 53 assigned to the operating arm 50, 52 can also be seen.

Figure 4:
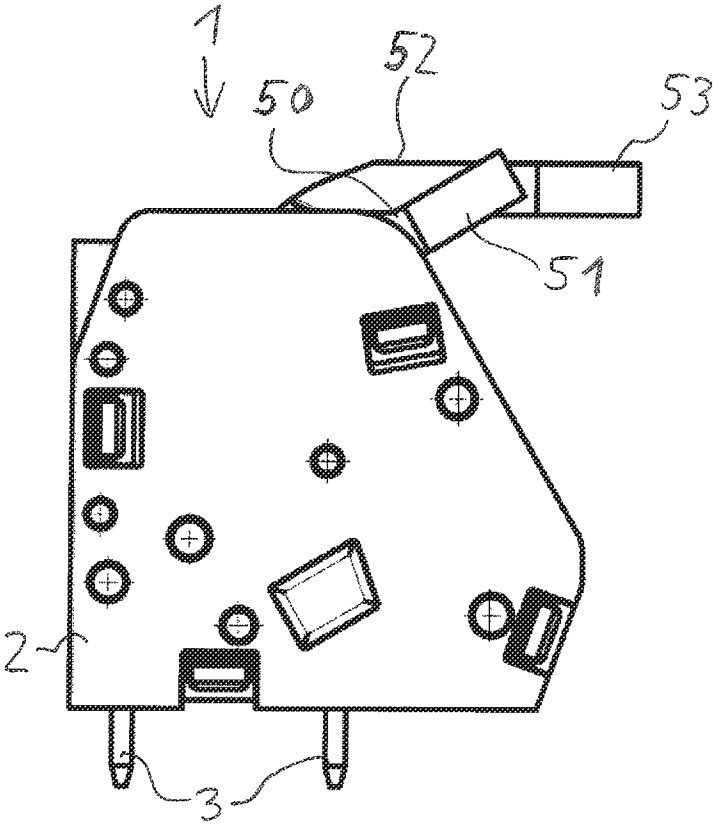
FIGS. 3, 4 show the conductor connection terminal according to FIG. 1 in different side views.
Figure 3:
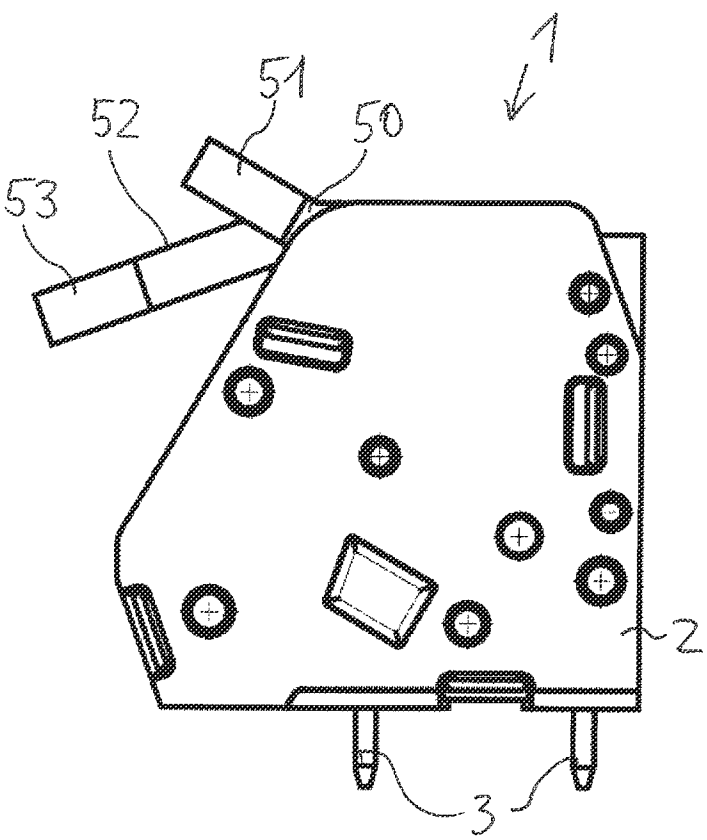

The different angled characteristics of the operating levers 5 or the first and second operating arms 50, 52 are to be illustrated with reference to FIGS. 3 and 4, wherein the second operating arm 52 is in an intermediate position between an open and a closed position of the clamping point in FIG. 4. The first operating arm 50 is angled upwards, that is to say in a direction away from the connection contacts 3. The second operating arm 52 has an oppositely designed angled portion, i.e. the second gripping surface 53 extends in the direction of the underside of the conductor connection terminal 1. FIG. 4 shows that the two gripping surfaces 51, 53 can be guided past one another without colliding.

Figure 5:
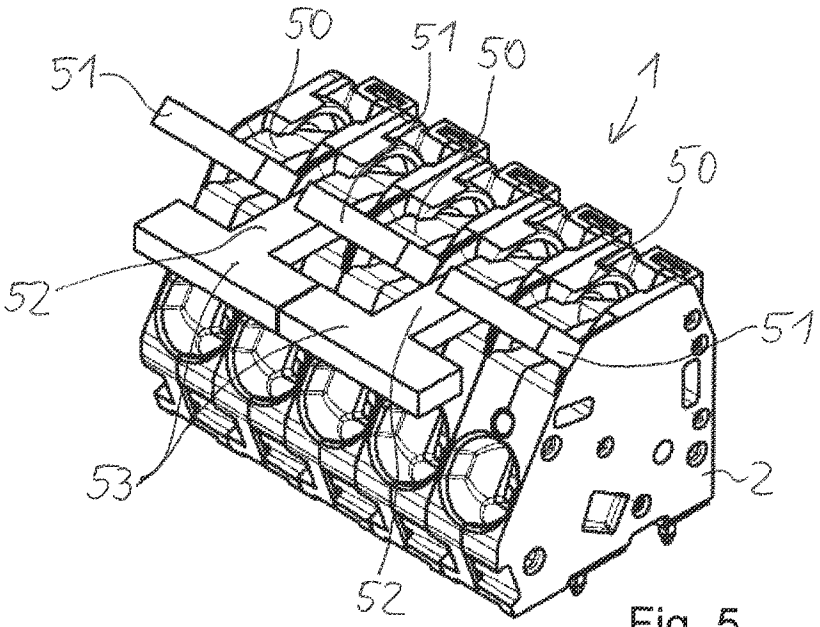
FIG. 5 shows a further embodiment of a conductor connection terminal in a perspective view.
Figure 6:
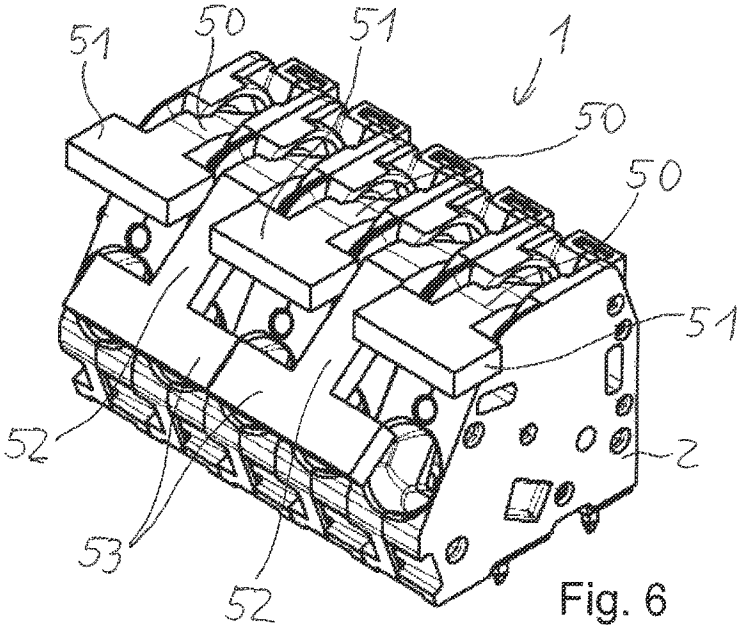
FIG. 6 shows a further embodiment of a conductor connection terminal in a perspective view.
Figure 7:
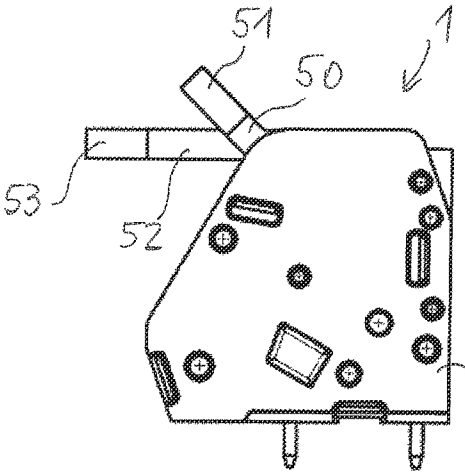
FIG. 7 shows the conductor connection terminal according to FIG. 5 in a side view.

With an otherwise comparably formed conductor connection terminal 1, FIGS. 5 to 8 show the potential of other types of angled characteristics of the operating arms 50, 52. In the embodiments of FIGS. 5, 7, the second operating arm 52, at least in the region protruding from the housing 2, does not have the angled portion towards the bottom of the conductor connection terminal previously described with reference to FIGS. 1 to 4, but rather extends, for example, substantially straight and preferably essentially parallel to the underside of the conductor connection terminal 1 in the area protruding from the housing 2. The first operating arm 50 has an upward angled portion, similar to the embodiment in FIGS. 1 to 4, wherein the angular dimension of the angled portion in this case is greater than in FIGS. 1 to 4.

Figure 8:
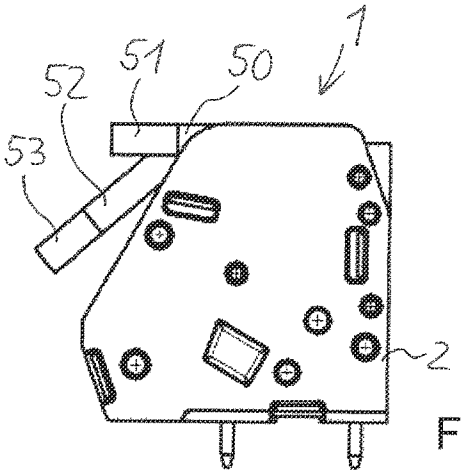
FIG. 8 shows the conductor connection terminal according to FIG. 6 in a side view.

FIGS. 6, 8 show an embodiment of the conductor connection terminal 1 in which the first operating arm 50 has no angled portion in the region protruding out of the housing 2, but for example runs substantially straight and preferably parallel to an underside of the conductor terminal 1. In contrast, the second operating arm 52, similar to FIGS. 1 to 4, has an angled portion towards the underside of the conductor connection terminal 1. The angular dimension of this angled portion can be greater than in the embodiment of FIGS. 1 to 4.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor connection terminal comprising:

at least one first spring-loaded clamping connection with a first operating lever for opening and closing a first clamping point formed between a first clamping leg and a first busbar section; and at least one second spring-loaded clamping connection with a second operating lever for opening and closing a second first clamping point formed between a second clamping leg and a second busbar section, wherein the at least first spring-loaded clamping connection and the at least second spring-loaded clamping connection are arranged directly side by side in a direction of arrangement in a housing in a direction transverse to a conductor insertion direction, wherein the at least first operating lever and the at least second operating lever have different shapes, and/or wherein the at least first spring-loaded clamping connection is arranged in a first housing section of the conductor connection terminal assigned to the first spring-loaded clamping connection, the at least first operating lever having a first gripping surface with a first width that is wider than the width of the first housing section in the direction of arrangement, and/or wherein the at least second spring-loaded clamping connection is arranged in a second housing section of the conductor connection terminal assigned to the second spring-loaded clamping connection, the at least second operating lever having a second gripping surface with a second width that is wider than the width of the second housing section in the direction of arrangement.

2. The conductor connection terminal according to claim 1, wherein the sum of the first width and the second width is greater than the sum of the width of the first housing section and the width of the second housing section in the direction of arrangement.

3. The conductor connection terminal according to claim 1, wherein the sum of the widths of the gripping surfaces of all operating levers of the conductor connection terminal is greater than the width of the entire housing in the direction of arrangement.

4. The conductor connection terminal according to claim 1, wherein the conductor connection terminal has at least two different types of operating levers, wherein the at least two different types of the operating levers are at least partially alternately arranged side by side in the direction of arrangement.

5. The conductor connection terminal according to claim 1, wherein the first width of the first gripping surface in the direction of arrangement is greater than the width of the first operating arm of the first operating lever, and/or wherein the second width of the second gripping surface in the direction of arrangement is greater than the width of the second operating arm of the second operating lever.

6. The conductor connection terminal according to claim 5, wherein the at least first operating lever and/or second operating lever has a T-shaped arrangement made of operating arm and gripping surface.

7. The conductor connection terminal according to claim 1, wherein the housing has a housing module receiving one, two or more spring-loaded clamping connections.

8. The conductor connection terminal according to claim 7, wherein two or more of the housing modules can be lined up side by side.

9. The conductor connection terminal according to claim 1, wherein one, several or all of the operating levers have an operating arm, which protrudes from the housing and which at the free end merges into a gripping surface for the manual operation of the operating lever.

10. The conductor connection terminal according to claim 9, wherein differently designed operating levers differ with regard to the length of an operating arm of the operating lever which protrudes from the housing.

11. The conductor connection terminal according to claim 9, wherein differently designed operating levers differ with regard to the different widths of the gripping surfaces of the operating levers.

12. The conductor connection terminal according to claim 9, wherein differently designed operating levers differ from one another in that the operating arm is angled differently.

13. The conductor connection terminal according to claim 9, wherein the first gripping surface of the at least first operating lever extends in the direction of arrangement up to the second operating arm of the adjacent second operating lever.

14. The conductor connection terminal according to claim 9, wherein the first operating arm and/or the second operating arm is oriented essentially perpendicular to the direction of arrangement and/or a pivoting plane in which the first and/or second operating lever is pivotable, essentially oriented perpendicular to the direction of arrangement.

15. The conductor connection terminal according to claim 9, wherein the first and second gripping surfaces overlap perpendicular to the direction of arrangement.

* * * * *